US006720741B2

(12) United States Patent
Crouse et al.

(10) Patent No.: US 6,720,741 B2
(45) Date of Patent: Apr. 13, 2004

(54) ELECTRONIC BALLAST HAVING OPEN CIRCUIT IN OUTPUT

(75) Inventors: Kent E. Crouse, Schaumburg, IL (US); Gueorgui L. Grouev, Arlington Heights, IL (US); William L. Keith, Algonquin, IL (US); Jacek Cachel, Wheeling, IL (US)

(73) Assignee: Universal Lighting Technologies, Inc., Madison, WI (US)

( * ) Notice: Subject to any disclaimer, the term of this patent is extended or adjusted under 35 U.S.C. 154(b) by 0 days.

(21) Appl. No.: 10/066,059

(22) Filed: Feb. 1, 2002

(65) Prior Publication Data

US 2003/0146716 A1 Aug. 7, 2003

(51) Int. Cl.[7] ..... H05B 37/00
(52) U.S. Cl. ..... 315/289; 315/291; 11/224
(58) Field of Search ..... 315/209 R, 291, 315/224, 247, 307, 219, 308, DIG. 5, DIG. 7, 289, 244, 226, 205, 227 R

(56) References Cited

U.S. PATENT DOCUMENTS 3,265,930 A 8/1966 Powell, Jr. ..... 315/209
3,987,356 A * 10/1976 Steigerwald ..... 363/44
4,042,856 A * 8/1977 Steigerwald ..... 315/246
4,507,698 A * 3/1985 Nilssen ..... 361/42
4,920,300 A * 4/1990 Scott ..... 315/209 R
5,059,869 A * 10/1991 Albach et al. ..... 315/289
5,319,286 A * 6/1994 Leyten ..... 315/289
5,461,287 A * 10/1995 Russell et al. ..... 315/209 R
5,680,017 A * 10/1997 Veldman et al. ..... 315/308
5,696,431 A * 12/1997 Giannopoulos et al. ..... 315/308
5,742,134 A * 4/1998 Wacyk et al. ..... 315/307
5,925,990 A * 7/1999 Crouse et al. ..... 315/307
6,008,590 A * 12/1999 Giannopoulos et al. . 315/209 R
6,388,397 B1 * 5/2002 Iwahori ..... 315/307

* cited by examiner

*Primary Examiner*—Haissa Philogene
*Assistant Examiner*—Chuc Tran
(74) *Attorney, Agent, or Firm*—Waddy & Patterson; Larry W. Brantley; Paul F. Willie

(57) ABSTRACT

Gas discharge lamps may conduct current from the common rail to earthen ground through a fixture containing the lamps. A transistor is coupled in series in the current path to the common rail. When the ballast is placed in a quiescent state, the transistor is rendered non-conducting, thereby solating the lamps from the common rail and preventing flicker. In accordance with another aspect of the invention, the control electrode of the transistor is coupled to a source of low voltage and the transistor is rendered non-conducting when the source of low voltage is turned off. The lamps can also be isolated from the common rail by using a semiconductor switch in the rectifier section or by referencing the output of the inverter to the high voltage rail.

11 Claims, 3 Drawing Sheets

ELECTRONIC BALLAST HAVING OPEN CIRCUIT IN OUTPUT

BACKGROUND OF THE INVENTION

This invention relates to electronic ballasts for gas discharge lamps and, in particular, to an improvement for ballasts that include a direct coupled output.

A gas discharge lamp, such as a fluorescent lamp, is a non-linear load to a power line, i.e. the current through the lamp is not directly proportional to the voltage across the lamp. Current through the lamp is zero until a minimum voltage is reached, then the lamp begins to conduct. Once the lamp conducts, the current will increase rapidly unless there is a ballast in series with the lamp to limit current.

An electronic ballast typically includes a rectifier for changing the alternating current (AC) from a power line to direct current (DC) and an inverter for changing the direct current to alternating current at high frequency, typically 25–60 kHz. Converting from alternating current to direct current is usually done with a full wave or bridge rectifier. A filter capacitor on the output of the rectifier stores energy for powering the inverter. Some ballasts include a boost circuit between the rectifier and the filter capacitor for increasing the voltage to the lamp. Many electronic ballast use what is known as a "flyback" boost circuit in which the energy stored in an inductor is supplied to the filter capacitor as small pulses of current at high voltage, utilizing the $\delta i/\delta t$ characteristic of an inductor to produce a high voltage. U.S. Pat. No. 3,265,930 (Powell) discloses such a ballast.

A modern electronic ballast typically includes an integrated circuit in the front end of the ballast to operate the boost circuit and provide power factor correction. "Power factor" is a figure of merit indicating whether or not a load in an AC circuit is equivalent to a pure resistance, i.e., indicating whether or not the voltage and current are sinusoidal and in phase. It is preferred that the load be the equivalent of a pure resistance (a power factor equal to one). Many semiconductor devices not only provide suitable AC to DC conversion but provide a "universal" front capable of being connected directly to any line voltage between 120 and 277 volts. Typically, the low voltage (3–18 volts DC) needed for powering the integrated circuits within an electronic ballast is derived from a small auxiliary power supply coupled to the line input.

The inverter section in a typical electronic ballast includes what is known as a direct coupled output; that is, a pair of switching transistors connected in series between a high voltage rail and a low voltage rail or common rail. The transistors conduct alternately, producing a square wave at their junction that is converted into a sine wave by a series resonant circuit coupled to the junction. A load, e.g. one or more lamps in series, is coupled in parallel with the series resonant capacitor.

Typically at input voltages above 250 volts, and less noticeably at lower input voltages, an electronic ballast having a direct coupled output is subject to flickering from lamps while the ballast is in a quiescent state. That is, the ballast is coupled to a line input but the inverter section is turned off. With the inverter section shut off, the switching transistors are non-conducting, which should mean that the lamps are off, but the lamps flicker.

In view of the foregoing, it is therefore an object of the invention to prevent flicker while an electronic ballast having a direct coupled output is in a quiescent state.

SUMMARY OF THE INVENTION

The foregoing objects are achieved in this invention in which it has been discovered that the lamps are sporadically conducting current from the common rail to earthen ground through a fixture containing the lamps. A transistor is coupled in series in the current path to the common rail. When the ballast is placed in a quiescent state, the transistor is rendered non-conducting, thereby isolating the lamps from the common rail and preventing flicker. In accordance with another aspect of the invention, the control electrode of the transistor is coupled to a source of low voltage and the transistor is rendered non-conducting when the source of low voltage is turned off. The lamps can also be isolated from the common rail by using a semiconductor switch in the rectifier section or by referencing the output of the inverter to the high voltage rail.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
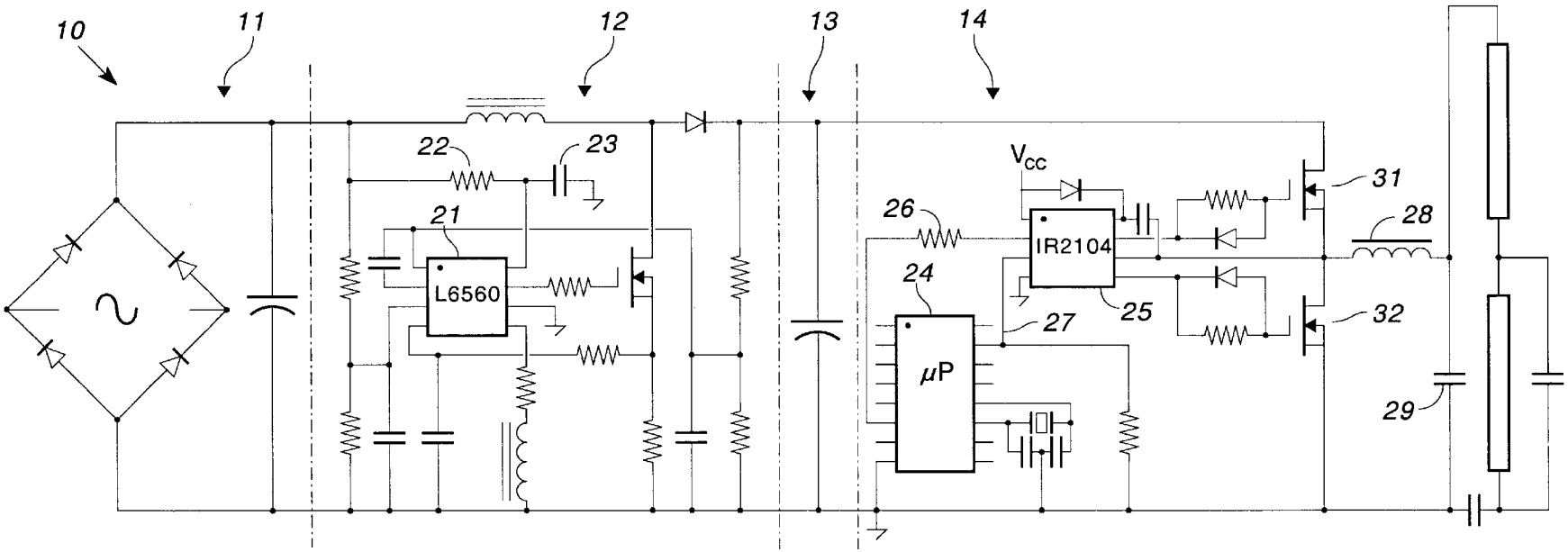
FIG. 1 (PRIOR ART)
FIG. 1 is a schematic of an electronic ballast having a direct coupled output.

FIG. 1 illustrates an electronic ballast constructed in accordance with the prior art. In the figures, pin 1 of each integrated circuit is indicated by a small dot and the pins are numbered consecutively counterclockwise. Ballast 10 includes rectifier section 11 for producing DC from line voltage, boost section 12 for increasing the DC voltage and providing power factor correction, storage section 13 for storing energy to drive a lamp, and inverter section 14 for driving a lamp.

Boost section 12 includes boost controller 21 implemented as an L6560 power factor correction circuit as sold by SGS-Thomson Microelectronics. Other power factor correction circuits could be used instead. Boost section 12 is essentially the same as the circuit recommended in the data sheets accompanying the L6560 integrated circuit.

Energy storage section 13 is illustrated as including a single, so-called "bulk" capacitor. Several bulk capacitors connected in parallel could be used instead. The rectifier, boost, and bulk capacitor together are the "front end" of an electronic ballast, an AC to DC converter for producing high voltage DC to power inverter 14.

Microprocessor 24 is coupled to two inputs of driver circuit 25. Specifically, high frequency pulses are coupled through resistor 26 through pin 2 of driver 25. Pin 3 of driver 25 is a disable input and is coupled to another output of microprocessor 24. In the event of a fault, disable line 27 is brought low, thereby shutting off the inverter. Inverter 14 includes a half bridge, series resonant, direct coupled output including inductor 28 and resonant capacitor 29. Switching transistors 31 and 32 conduct alternately to produce a series of high voltage pulses that inductor 28 and capacitor 29 convert into sinusoidal alternating current.

When ballast 10 is first turned on, rectified AC flows through resistor 22 to capacitor 23, charging the capacitor and providing operating power for controller 21. Other, low voltage power supplies (not shown) can be coupled to the line input for powering other integrated circuits in ballast 10.

Figure 2:
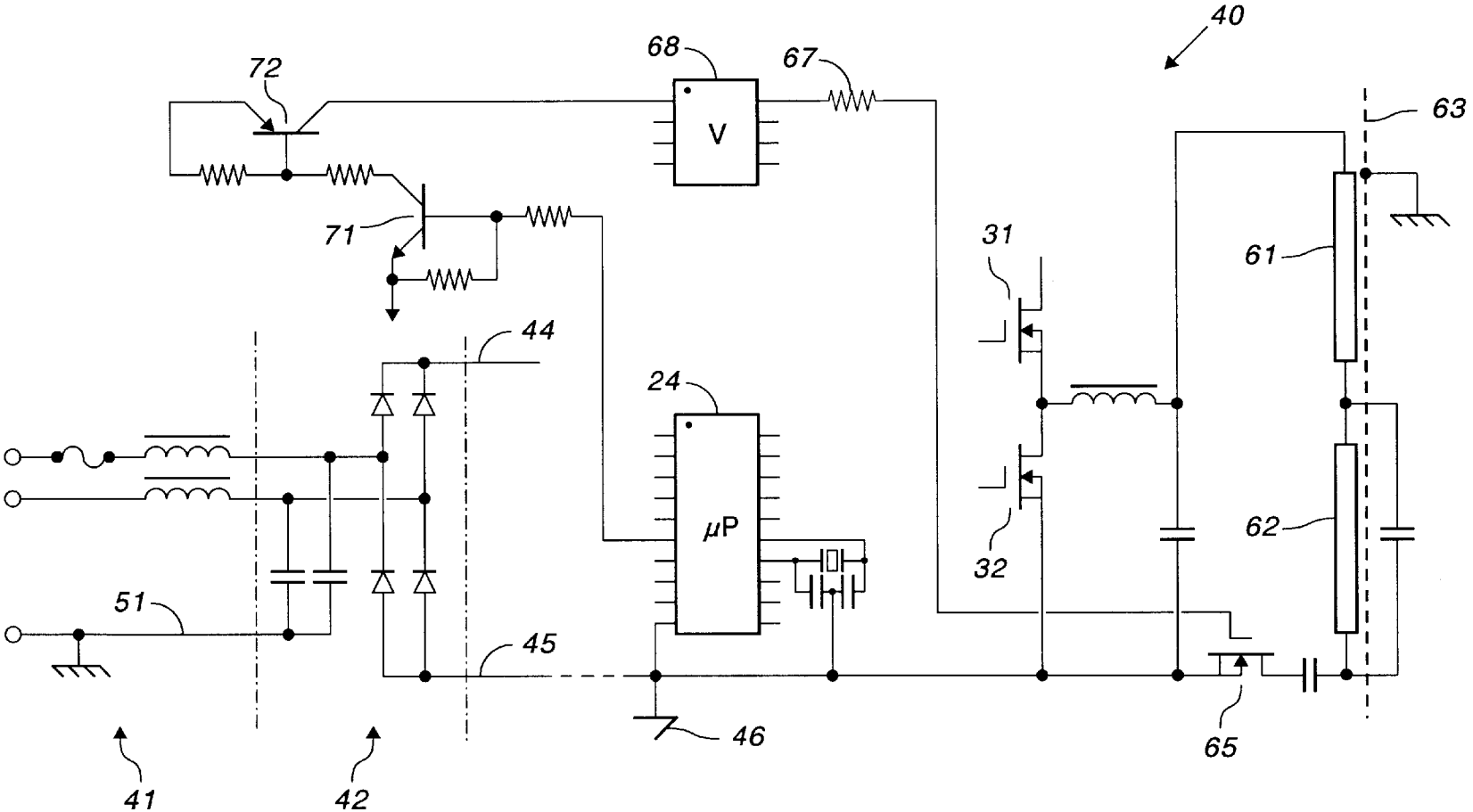
FIG. 2 is a partial schematic of an electronic ballast constructed in accordance with a preferred embodiment of the invention.

FIG. 2 is a partial schematic of a ballast constructed in accordance with a preferred embodiment of the invention. In FIG. 2, ballast 40 includes line input section 41 and rectifier section 42. One output from rectifier section 42 is positive voltage line 44 and another output is common rail 45, also known as the common rail. A ground symbol, such as symbol 46, is often attached to the common rail and refers to circuit ground, not an earthen ground, i.e. a connection to a copper pipe suitably buried in top soil. Neutral line 51 of input 41 should be coupled to earthen ground. As is clear from FIG. 2, there is no resistive path to earthen ground from common rail 45. It has been found that the voltage on rail 45 can vary considerably relative to earthen ground and therein lies part of the problem.

Gas discharge lamps 61 and 61 are typically mounted in a metal fixture, represented by dashed line 63, that is coupled to an earthen ground. The lamps actually form small capacitors relative to the ground plane provided by the fixture. When ballast 41 is in a quiescent state, that is, the front end is turned on but the inverter is off, positive voltage line 44 and common rail 45 are receiving pulsating direct current from rectifier section 42. It has been discovered that this pulsating direct current can be capacitively coupled to fixture 63 from common rail 45, causing the lamps to glow slightly or flicker.

In accordance with one aspect of the invention, field effect transistor (FET) 65 has the source-drain path thereof connected in series between common rail 45 and the lamps. When transistor 65 is conducting, the lamps are on and the ballast operates normally. When transistor 65 is not conducting, a pulsating direct current is prevented from reaching fixture 63.

There are many ways to control transistor 65, which could be coupled to an output pin of microprocessor 24, for example. In accordance with another aspect of the invention, transistor 65 is controlled by coupling the gate electrode through resistor 67 to low voltage supply 68. Low voltage supply 68 powers other integrated circuits (not shown) and is controlled, through interface transistors 71 and 72, by microprocessor 24. Low voltage supply 68 is used whether or not the invention is incorporated into the circuit. Thus, in accordance with this aspect of the invention, one avoids an additional interface circuit and avoids tying up another output of microprocessor 24 by coupling to low voltage supply 68.

Figure 3:
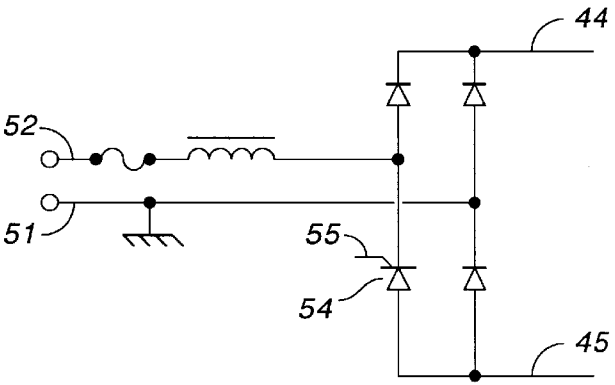
FIG. 3 is a schematic of an alternative embodiment of the invention.

FIG. 3 illustrates an alternative embodiment of the invention in which the common rail is isolated by a semiconductor switch; specifically, a silicon controlled rectifier (SCR). Neutral line 51 and power line 51 are coupled to a full wave bridge rectifier including SCR 54 as one arm of the bridge. During normal operation, SCR 54 conducts synchronously with the line voltage and the bridge operates as a full wave rectifier. When the ballast is in quiescent mode, SCR 54 is turned off and common rail 45 is isolated from line 52.

Gate 55 of SCR 54 is controlled by a microprocessor (not shown in FIG. 3) either directly from an output of the microprocessor or indirectly by coupling the gate to a low voltage supply (not shown in FIG. 3), which is controlled by a microprocessor.

Figure 4:
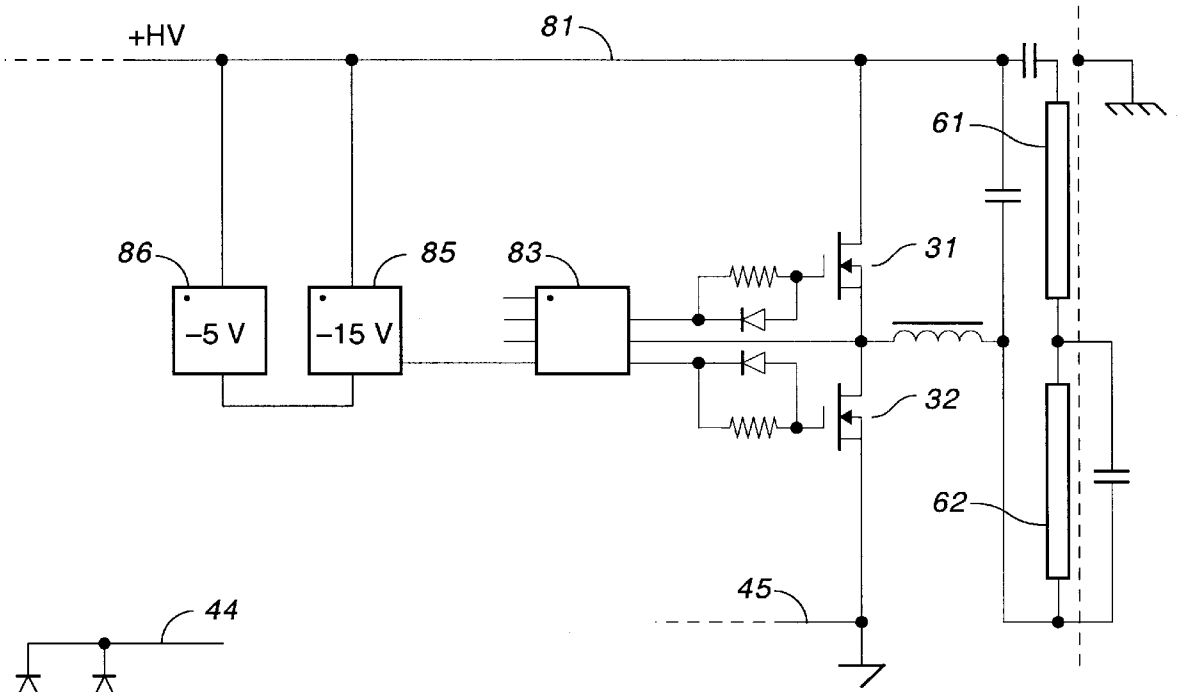
FIG. 4 is a schematic of another alternative embodiment of the invention.

FIG. 4 illustrates another alternative embodiment of the invention in which the lamps are isolated from common by referencing the lamps and related control circuits in the inverter section to the high voltage rail. In the inverter section of the ballast, switching transistors 31 and 32 are coupled between high voltage rail 81 and common rail 45. Driver circuit 83, low voltage supply 815 and low voltage supply 86 are referenced to high voltage rail 81 rather than to common rail 45. Similarly, lamps 61 and 62 are referenced to high voltage rail 81 rather than to common rail 45.

The invention thus prevents flicker while an electronic ballast having a direct coupled output Is in a quiescent or stand-by mode. Flicker can be prevented with a minimum number of components and without reprogramming the microprocessor if the added switch is controlled by a low power circuit that is shut off during quiescent mode.

Having thus described the invention, it will be apparent to those of skill in the art that various modifications can be made within the scope of the invention. For example, any suitable semiconductor switch or mechanical switch can be substituted for FET 65 or SCR 54.

What is claimed as the invention is:

1. In an electronic ballast for gas discharge lamps, said ballast including a direct coupled output and a common rail, the improvement comprising:

a switch coupled in series between said common rail and said direct coupled output to provide a selectively operated open circuit that prevents current from flowing between said common rail and said direct coupled output when said ballast is operated in a quiescent mode.

2. The ballast as set forth in claim 1 wherein said switch is a semiconductor device having a control electrode.

3. The ballast as set forth in claim 2 and further including a source of low voltage, wherein said control electrode is coupled to said source of low voltage.

4. An electronic ballast for a gas discharge lamp, said ballast comprising:

a converter section having a line voltage input, a high voltage rail, and a common rail;

an inverter section coupled to said high voltage rail and common rail, said inverter section including a direct coupled output;

a switch in said inverter section coupled in series between said common rail and said direct coupled output, and operable to isolate said common rail from said direct coupled output when said inverter section is turned off.

5. The electronic ballast as set forth in claim 4 wherein: said switch is non-conducting when said inverter is turned off and said switch conducts when said inverter is turned on, thereby blocking DC pulses from said output when said switch is non-conducting.

6. The electronic ballast as set forth in claim 5 wherein said switch is a semiconductor switch having a control electrode.

7. The electronic ballast as set forth in claim 6 wherein said converter section further includes: a source of low voltage; and said control electrode is coupled to said source of low voltage.

8. In an electronic ballast for gas discharge lamps, said ballast including a full wave rectifier bridge coupled to a power line input, a direct coupled output and a common rail, the improvement comprising:

a switch substituted for one arm of the bridge between said power line input and said common rail, said switch being open during quiescent mode of said ballast for isolating said common rail from said power line input.

9. The ballast as set forth in claim 8 wherein said switch is a semiconductor device having a control electrode.

10. The ballast as set forth in claim 9 wherein said semiconductor device is an SCR.

11. In a method for operating an electronic ballast for gas discharge lamps, said ballast including a direct coupled output and a common rail, the improvement comprising the steps of:

operating the ballast in a quiescent mode; and isolating the gas discharge lamps from the common rail while operating the ballast in the quiescent mode.

* * * * *